United States Patent [19]

Holmberg

[11] Patent Number: 4,657,433

[45] Date of Patent: Apr. 14, 1987

[54] SHORELINE EROSION CONTROL MAT AND METHOD OF USE THEREFOR

[76] Inventor: Dick L. Holmberg, P.O. Box 100, Whitehall, Mich. 49461

[21] Appl. No.: 871,456

[22] Filed: Jun. 5, 1986

[51] Int. Cl.[4] ..... E02B 3/04

[52] U.S. Cl. ..... 405/26; 405/21

[58] Field of Search ..... 405/21, 23, 25, 26

[56] References Cited

U.S. PATENT DOCUMENTS

| | | | |
|---|---|---|---|
| 716,572 | 12/1902 | Neale . | |
| 752,637 | 2/1904 | Mankedick . | |
| 3,538,711 | 11/1970 | Nielsen . | |
| 3,561,219 | 2/1971 | Nishizawa et al. . | |
| 3,563,037 | 12/1971 | Stammers . | |
| 3,874,177 | 4/1975 | De Winter . | |
| 4,367,977 | 1/1983 | Schaaf et al. . | |
| 4,490,071 | 12/1984 | Morrisroe | 405/24 |
| 4,534,675 | 8/1985 | Morrisroe | 405/24 |

FOREIGN PATENT DOCUMENTS

| | | | |
|---|---|---|---|
| 1942406 | 1/1971 | Fed. Rep. of Germany . | |
| 7710671 | 4/1979 | Netherlands | 405/25 |

*Primary Examiner*—Cornelius J. Husar
*Assistant Examiner*—Anthony Knight
*Attorney, Agent, or Firm*—Price, Heneveld, Cooper, DeWitt & Litton

[57] ABSTRACT

A shoreline erosion control device having a base mat with a water permeable but soil retaining upper membrane secured thereto to form a plurality of forwardly opening pockets therebetween. Floatation extends along the forward edge of the upper membrane, and anchoring elements extend along substantially the entire leading edge and trailing edge of the base mat, with straps joining the upper membrane and base mat in order to limit the opening of the pockets.

27 Claims, 8 Drawing Figures

SHORELINE EROSION CONTROL MAT AND METHOD OF USE THEREFOR

BACKGROUND OF THE INVENTION

The present invention relates to structures for control of shoreline erosion, and in particular to structures that include a fabric or other membrane used to filter suspended sand and sediment.

A variety of structures have been used in an attempt to ameliorate or control the erosion of shoreline along the coasts of both freshwater lakes and oceans. Depending upon the prevailing currents or wave patterns along a given section of coast, certain structures may prove more effective than others in one area yet less effective in other areas. Although many different structures have been adapted for different erosion conditions, heretofore a large number of erosion control devices have provided rigid structures that can actually be counterproductive to controlling erosion over the long term or have the effect of merely shifting the erosion to another location. For example, rigid seawalls, groins or pylons provide solid barriers to normal currents and wave action. When water which is moving toward the shore strikes the rigid barrier it is either deflected downwardly against the sea bottom or laterally along the wall. This action causes the seabed to be subjected to a focused or accelerated erosion in that region since the eroding effect of the moving water is not dissipated over a wider area.

Further, the presence of rigid barriers, whether extending up out of the water or submerged, can reduce the field of use for the shoreline being protected. These rigid structures can pose a danger of injury to swimmers who may accidentally strike the barrier, as well as posing a similar impediment to boating and fishing. Further, rigid barriers extending above the water's surface dramatically detract from a coastline's natural beauty.

Other types of erosion control structures have used various fabrics which are placed on the embankment in order to hold the underlying sand in place and prevent the sand from being washed out away from the shoreline. Merely holding existing sand in place, however, does not aid in preventing erosion from areas that are not actually covered by such fabric.

SUMMARY OF THE INVENTION

The erosion control device of the present invention provides a membrane that permits water moving toward shore and carrying with it entrained sand, sediment or other soil to pass over the erosion control structure. As water recedes from the shoreline the flexible membrane filters the entrained soil from the water, the soil being collected in the region of the erosion control device and thus building up the seabed in that region. The erosion control device includes a base mat that is anchored along its leading edge and trailing edge, with a water permeable membrane joined to the upper surface of the mat to form a pocket that opens toward the shore. The upper membrane includes floatation along the pocket opening to allow wave action to close and open the sand entrapping pocket as water passes over the structure, although the base mat is anchored so that the upper membrane is normally submerged.

The erosion control device is particularly beneficial during storms or other periods of high wave action, when surges or turbulence in he water stirs up an increased amount of sand and other soil. Since the erosion control device is made from flexible materials the structure does not provide a rigid barrier that redirects the movement of water until the seabed profile has been built up. The structure is very lightweight and therefore may be readily stored, transported and installed. The flexible structure does not pose the same problems to boaters and swimmers as a rigid barrier, and the device traps sand that water action has picked up from other locations removed from the structure itself in order to build up the seabed in the region of the device.

DETAILED DESCRIPTION OF THE PREFERRED EMBODIMENTS

Figure 1:
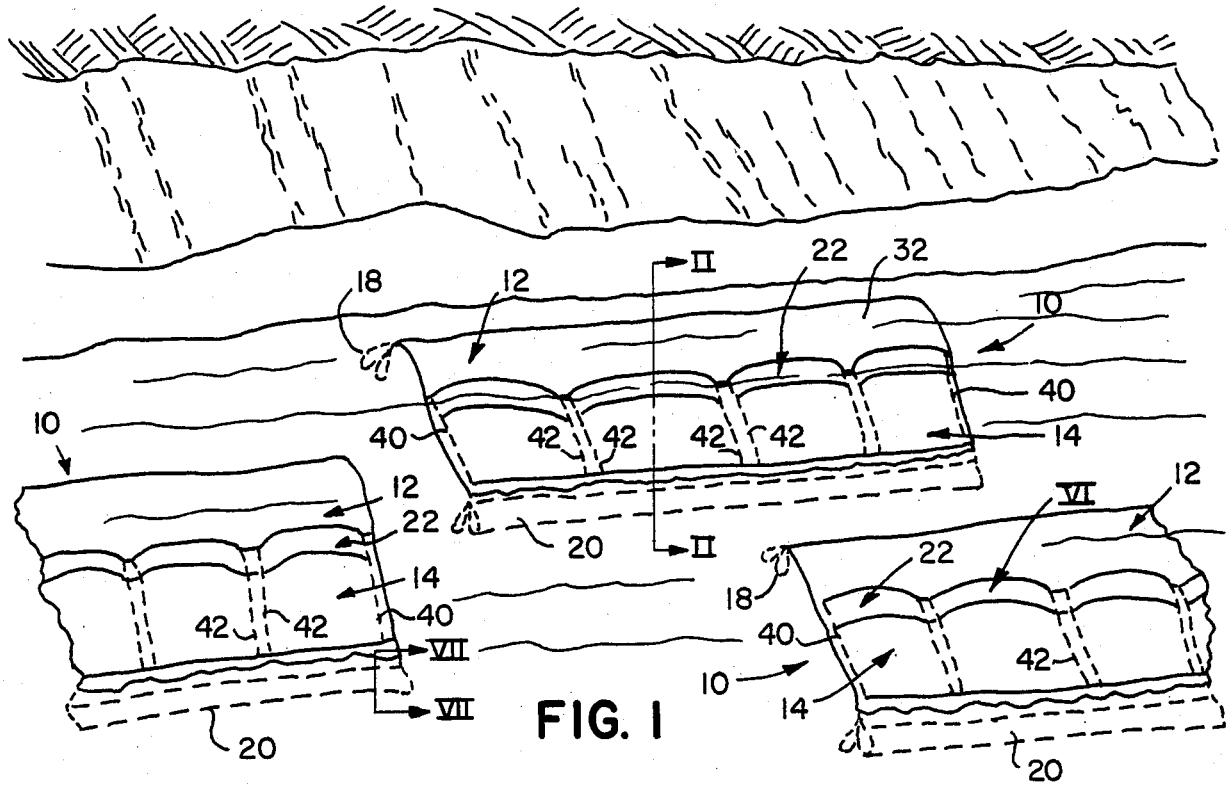
FIG. 1 is a fragmentary perspective view of several erosion control devices embodying the present invention installed along a shoreline to be protected.
Figure 2:
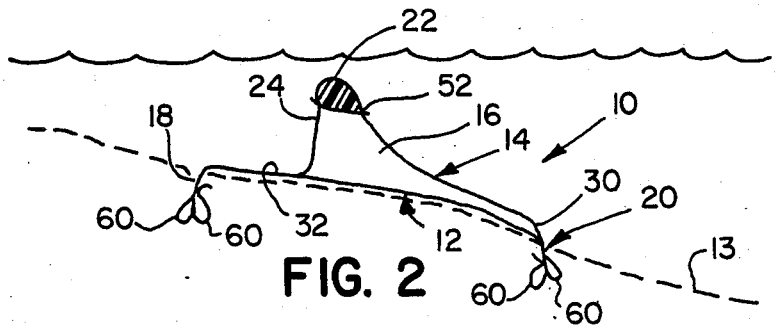
FIG. 2 is a sectional view taken along line II—II of FIG. 1 showing an erosion control device shortly after installation.
Figure 3:
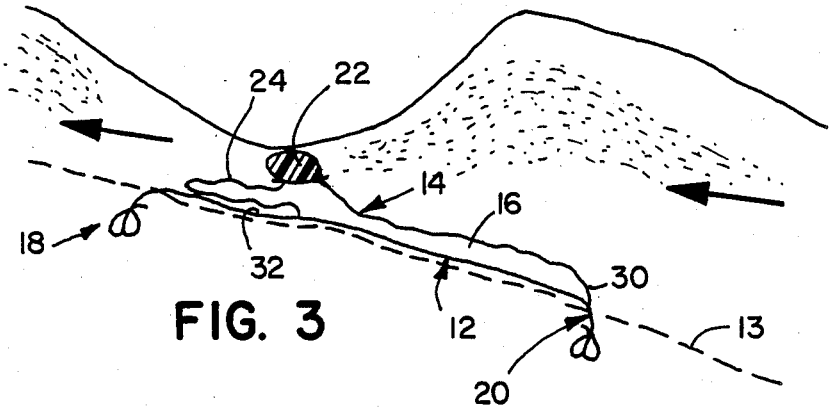
FIG. 3 is a sectional view of the erosion control device of FIG. 2 shown in operation as water moves over the erosion control device towards the shore.
Figure 4:
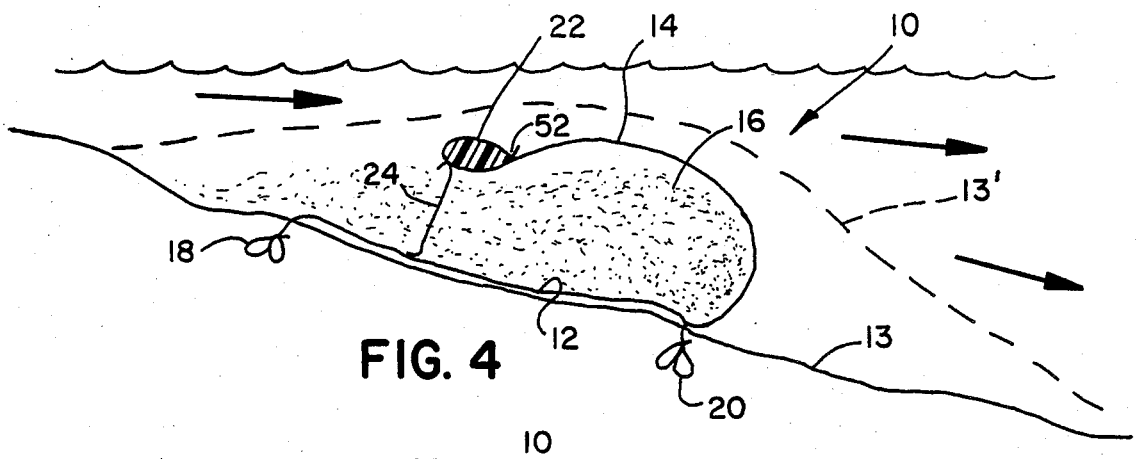
FIG. 4 is a sectional view of the erosion control device of FIG. 2 shown in operation having filled with sand and the surrounding water shown moving away from the shore.

The present invention is embodied in an erosion control device, a preferred embodiment of which is shown in FIG. 1 and referenced generally by the numeral 10. Erosion control device 10 includes an underlying base mat 12 that is jointed to an upper water permeable flexible membrane 14 that forms a pocket 16 therebetween. Base mat 12 is anchored in the seabed 13 along its leading edge by an anchor 18 and along its trailing edge by an anchor 20 so that pocket 16 opens toward the shore. Floatation 22 extends along upper membrane 14 at the opening of pocket 16, and a series of straps 24 (FIG. 2) limit the maximum opening of pocket 16. As water carrying entrained sand moves toward shore as shown in FIG. 3, the water passes over erosion control device 10. As the water recedes from the shore as shown in FIG. 4, floatation 22 opens pocket 16 so that membrane 14 filters the sand from the receding water. The sand is trapped within pocket 16 and gradually builds up the bottom profile 13' about erosion control device 10. Erosion control device 10 is particularly useful in reducing wave induced erosion from high wave action caused by storm surges.

Erosion control device 10 may be used along the shoreline of an ocean, inland lake or other body of water subject to erosion along its coast. To that end, the term seabed as used herein refers to the bed of any such body of water and is not limited to salt water oceans or seas. As shown in FIG. 2, erosion control device 10 is formed from a water permeable fabric that operates to filter sand, sediment, gravel and other soil particles from water. Preferably, erosion control device 10 is made of a sheet of geotextile material and most preferably a woven geotextile material, having a weave tight enough to permit water passage but which prevents the passage of soil. One suitable geotextile material is marketed by Philips Fibers Corporation under the trademark SUPAC, but other suitable materials may be used.

Base mat 12 and upper membrane 14 are integrally formed from an elongated sheet of fabric that is folded longitudinally. Upper membrane 14 is folded as a shorter section of fabric so that lower base mat 12 extends to a leading edge forward of upper membrane 14, thereby providing a single ply of fabric in a region 32 forward of pocket 16. As used herein, the terms "leading" and "forward" refer to those portions nearer or facing the shore, while the terms "trailing" and "rear" refer to those regions extending away from or spaced farther from the shore. Single ply region 32 provides an additional area forward of pocket 16 on which sand accumulates as pocket 16 fills. Also, single ply region 32 permits the anchoring of base mat 12 forward of pocket 16, which provides a sturdy anchor for mat 12 that reduces the likelihood that receding wave action within pocket 16 will lift the leading edge of base mat 12 up out of the bottom. The extension of single ply region 32 forward of pocket 16 may reduce the likelihood of wave action undermining anchor 18 as pocket 16 fills with sand and increasingly impedes water movement.

Figure 6:
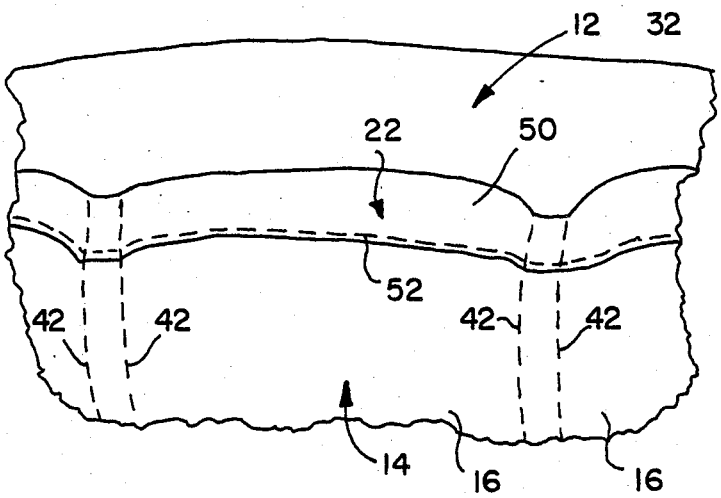
FIG. 6 is a fragmentary plan view of an erosion control device taken in the region of Arrow 6 in FIG. 1.

As shown in FIG. 1, along each side of erosion control device 10 is side stitching 40 that joins the side edges of upper membrane 14 with base mat 12. Intermediate side stitchings 40 are a series of intermediate lines of stitching 42 that join upper membrane 14 and base mat 12. Intermediate stitchings 42 extends along lines normal to the leading edge and trailing edge of device 10. As shown in FIG. 6, intermediate stitchings 42 are grouped in spaced pairs of parallel lines that produce spaced, laterally adjacent pockets 16. Pockets 16 are preferably in the range of five to ten feet wide between stitchings 42. Each erosion control device 10 includes a plurality of laterally arrayed pockets 16, such as for example, in FIG. 1 each device 10 is shown having four laterally adjacent pockets 16. Erosion control device 10 may be extended to the length desired by including additional pockets 16 sufficient to extend along the shoreline to be protected. Alternatively, a plurality of erosion control devices 10 may be laid out either in a side-by-side or a staggered relationship to increase the area of shoreline protected.

As shown in FIG. 6, a hem 50 is folded over along the leading edge of upper membrane 14 and joined by a line of stitching 52 so that hem 50 forms a floatation pocket that extends along the leading edge of pocket 16. Floatation 22 is trapped within hem 50 in order to provide floatation along the entire opening to pocket 16. Floatation 22 therefore provides a buoyancy valve at the opening to pocket 16 which biases open pocket 16. When installed, erosion control device 10 is preferably anchored so that floatation 22 in hem 50 is suspended several inches beneath the water surface. However, as wave action moves across erosion control device 10, floatation 22 lowers and raises with the water flow, particularly when storm surges cause deep troughs between waves. Floatation 22 may be any suitable elastomeric or polymeric floatation material, although preferably floatation 22 is a closed cell polyvinyl chloride (PVC) foam material. The PVC material may be in a variety of conditions, such as separate pellets trapped within hem 50 or a series of tubular extrusion segments of PVC material that extend along the hem. Preferably, the PVC is in smaller segments to permit hem 50 to flex freely.

Figure 7:
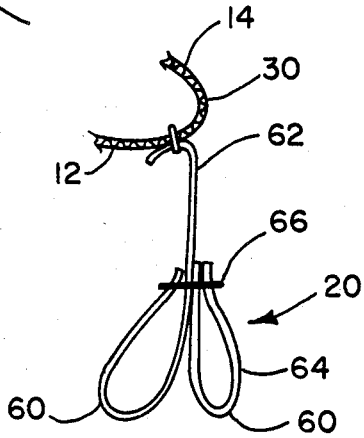
FIG. 7 is a sectional view of an anchoring element taken along line VII—VII of FIG. 1.
Figure 8:
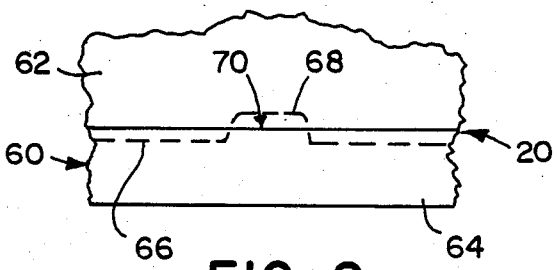
FIG. 8 is a fragmentary, front elevational view of the anchoring element of FIG. 7.

As shown in FIG. 2, anchors 18 and 20 each include two separate anchoring loops 60. Shown in more detail in FIG. 7 is trailing edge anchor 20. Anchor 20 is formed by a flap of material 62 stitched to the trailing edge of base mat 12. Flap 62 hangs from mat 12 and is looped back up to form one anchoring loop 60. A second strip of material 64 is folded in half to form the other anchoring loop 60, with a single line of stitching 66 closing the top of both loops 60 as well as joining material 64 to flap 62. As shown in FIG. 8, stitching 66 extends along the upper edge of loop 60, and includes a jog 68 that runs up above the upper edge of loop 60. This jog 68 provides a small ballast opening 70 through which sand or other ballast is introduced into each anchor pocket 60. A single pass of stitching may therefore form loop 60 and also provide ballast opening 70.

In order to fill anchor pocket 60, sand may be pumped through ballast opening 70 until anchoring loop 60 is at least partially filled. Wholly or partially filled anchoring loops 60 are buried in the seabed, and thereafter water action will fill the remainder of anchoring loops 60. Leading edge anchor 18 is similar to trailing edge 20, except that forward single ply region 32 is simply folded down rather than requiring a separate section of material such as flap 62 to be stitched onto base mat 12. Anchors 18 and 20 therefore provide a complete closure against the seabed along the entire leading and trailing edges of mat 12.

Figure 5:
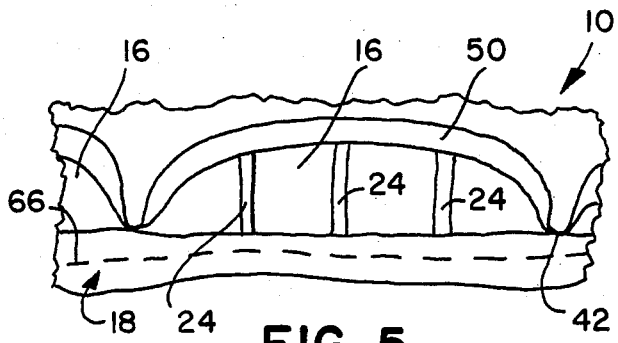
FIG. 5 is a front elevational view of an erosion control device shown in FIG. 1, showing the forward opening into the sand entrapping pocket.

As shown in FIG. 5, straps 24 are short sections of webbing that limit the opening to pocket 16. Straps 24 therefore maintain floatation 22 in a submerged condition and also provide a more uniform profile to the opening of pocket 16. Straps 24 are secured to the undersurface of membrane 14 and upper surface of mat 12. Straps 24 are spaced along the opening of each pocket 16, and as shown in FIG. 5 three straps 24 are included for each pocket 16. Alternatively, other numbers of straps 24 may be provided for each pocket.

The material used for erosion control device 10 preferably provides some stretch to allow membrane 14 to lift and pocket 16 to open relatively freely. Alternatively, upper membrane 14 may be provided with a greater width than that of base mat 12, so that when upper membrane 14 is stitched to base mat 12 excess material is provided in upper membrane 14 between intermediate stitching 42 and edge stitching 40. This permits pocket 16 to open readily due to floatation 22 and the influx of sand.

Although erosion control device 10 is described as formed from a single section of geotextile material folded at bend 30, alternatively separate sections of material are stitched together to form pockets 16. Similarly, laterally adjacent pockets 16 can be stitched together from separate section of material, rather than forming device 10 from a single continuous length of fabric.

It is to be understood that the above is merely a description of the preferred embodiment and that various modifications or improvements may be made without departing from the spirit of the invention disclosed herein. The scope of protection afforded is to be determined by the claims which follow and the breadth of protection that the law allows.

The embodiments of the invention in which an exclusive property or privilege is claimed are defined as follows.

1. An erosion control device for controlling erosion along the seabed of a body of water and shore, comprising:

a base mat;

means for anchoring said base mat to the seabed of a body of water;

a flexible, water permeable membrane having a forward edge, a trailing edge and sides, said membrane secured to said base mat at said membrane trailing edge and said membrane sides to form a forwardly opening pocket therebetween, said membrane being substantially impermeable to soil particles; and a floatation element coupled to said membrane at said forward edge, said floatation element biasing said pocket open when said base mat is secured to a seabed, whereby when said erosion control device is anchored with said pocket opening toward the shore, waves pass over said membrane toward the shore and soil entrained in receding water is collected in said pocket.

2. The erosion control device of claim 1, further comprising:

means for limiting the opening of said pocket.

3. The erosion control device of claim 2, wherein:

said limiting means includes a strap extending between said base mat and said membrane at said opening.

4. The erosion control device of claim 3, wherein:

said floatation element extends along said membrane forward edge.

5. The erosion control device of claim 4, wherein:

said membrane is folded over at said membrane forward edge to form a hem thereat, and said floatation element is secured within said hem.

6. The erosion control device of claim 5, wherein:

said anchoring means comprises a first anchoring element extending along a forward edge of said base mat and a second anchoring element extending along a trailing edge of said base mat.

7. The erosion control device of claim 6, where in:

said anchor elements each comprise an anchoring flap of flexible material depending from said base mat and a plurality of anchoring pockets coupled to said anchoring flap, said anchoring pockets configured and adapted to be filled with ballast.

8. The erosion device of claim 7, wherein:

said first anchoring element is spaced forward of said pocket.

9. The erosion control device of claim 8, wherein:

said membrane and said base mat are an integral section of material folded over at said membrane trailing edge.

10. The erosion control device of claim 1, wherein:

said membrane is secured to said base mat to form a plurality of said pockets arrayed in a sidewardly adjacent row.

11. The erosion control device of claim 1, wherein:

said floatation element extends along said membrane forward edge.

12. The erosion control deviceof claim 11, wherein:

said membrane is folded over at said membrane forward edge to form a hem thereat, and said floatation element is secured within said hem.

13. The erosion control device of claim 1, wherein:

said anchoring means comprises a first anchoring element extending along a forward edge of said base mat and a second anchoring element extending along a trailing edge of said base mat.

14. The erosion control device of claim 13, wherein:

said anchor elements each comprise an anchoring flap of flexible material depending from said base mat and a plurality of anchoring pockets coupled to said anchoring flap, said anchoring pockets configured and adapted to be filled with ballast.

15. The erosion control device of claim 14, wherein:

said first anchoring element is spaced forward of said pocket.

16. An erosion control device for controlling erosion along the seabed of a body of water and shore, comprising:

a base mat having a forward edge and a trailing edge;

a flexible, water permeable membrane that is substantially impermeable to soil particles, said membrane having a forward edge, a trailing edge and sides, and said membrane secured to said base mat at said membrane trailing edge and said membrane sides to form a forwardly opening pocket therebetween; and means for anchoring said base mat in the seabed of a body of water, said anchoring means extending along substantailly the entirety of said base mat forward edge and along substantially the entirety of said base mat trailing edge, whereby with said base mat anchored with said pocket opening toward shore, said membrane permits water moving toward shore to pass over said membrane and entrained soil particles in water moving away from shore to be collected in said pocket.

17. The erosion control device of claim 16, wherein:

said anchoring means includes an anchoring flap of flexible material depending from said base mat along said base mat forward edge and along said base mat trailing edge, and a plurality of anchoring pockets coupled to each said anchoring flap, said anchoring pockets configured and adapted to be filled with ballast.

18. A method of controlling erosion along the bottom of a body of water and shore, comprising:

providing an erosion control device comprising, a base mat, a flexible water permeable membrane that is substantially impermeable to soil particles and having a forward edge, a trailing edge and sides, said membrane secured to said base mat at said membrane trailing edge and said membrane sides to form a forwardly opening pocket therebetween;

orienting said erosion control device so that said pocket opens toward the shore of the body of water;

spacing said erosion control device from the shore; and anchoring said erosion control device to the bottom of the body of water so that water moving toward shore passes over said membrane and soil entrained in receding water is trapped in said pocket.

19. The method of claim 18, wherein:

said providing step includes providing a floatation element coupled to said membrane, said floatation element biasing open said pocket.

20. The method of claim 19, wherein:

said anchoring step includes anchoring said erosion control device such that said floatation element is normally submerged.

21. The method of claim 20, wherein:

said providing step includes forming a floatation pocket extending along said membrane forward edge and securing said floatation element in said floatation pocket.

22. The method of claim 21, wherein:

said providing step includes providing a strap extending between said membrane forward edge and said base mat, and limiting the maximum opening of said forwardly opening pocket with said strap.

23. The method of claim 18, wherein:

said anchoring step includes anchoring said base mat along substantially an entire forward edge of said base mat and along substantially an entire trailing edge of said base mat.

24. The method of claim 23, wherein:

said providing step includes providing an anchoring flap of flexible material depending from said base mat along said base mat forward edge and along said base mat trailing edge, said anchoring flaps each having an anchoring pocket extending therealong, and said anchoring step includes filling said anchoring pockets with soil and burying said anchoring pockets in said seabed.

25. The method of claim 18, wherein:

said providing step includes providing an erosion control device having a plurality of said forwardly opening pockets formed thereon, and said orienting step includes orienting said erosion control device so that said pockets extend generally parallel to the shore.

26. The method of claim 25, wherein:

said providing step includes providing a plurality of said erosion control devices; and said orienting step, said spacing step and said anchoring step include orienting, spacing and anchoring said plurality of erosion control devices.

27. An erosion control device for controlling erosion along the seabed of a body of water and shore, comprising:

a base mat having a forward edge and a trailing edge;

a first anchoring flap depending along both said base mat forward edge and a second anchoring flap depending along said base mat trailing edge;

a plurality of anchoring pockets on each of said anchoring flaps;

a flexible, water permeable fabric that is substantially impermeable to soil particles, said fabric having a forward edge, a trailing edge and sides, said fabric secured to said base mat at said fabric trailing edge and said fabric sides to form a forwardly opening pocket therebetween; and a floatation element extending along said fabric forward edge biasing said pocket open when said base mat is secured to a seabed.

* * * * *